United States Patent [19]

Kimoto

[11] 4,363,032

[45] Dec. 7, 1982

[54] SHEET FEEDING CONTROL DEVICE FOR USE IN A COIN WRAPPING MACHINE

[75] Inventor: Toyoki Kimoto, Tokyo, Japan

[73] Assignee: Laurel Bank Machine Co., Ltd., Tokyo, Japan

[21] Appl. No.: 201,611

[22] Filed: Oct. 28, 1980

[30] Foreign Application Priority Data

Dec. 13, 1979 [JP] Japan ..... 54-162120

[51] Int. Cl.[3] ..... G08B 21/00; B65B 57/04

[52] U.S. Cl. ..... 340/679; 53/212; 53/507; 340/675

[58] Field of Search ..... 340/675, 679; 53/212, 53/508, 507; 226/8, 24, 100

[56] References Cited

U.S. PATENT DOCUMENTS 3,906,964 9/1975 Ushio et al. ..... 53/212
3,948,510 4/1976 Iwamoto et al. ..... 340/675
4,224,777 9/1980 Miyazaki et al. ..... 53/212
4,224,778 9/1980 Miyazaki et al. ..... 53/212
4,282,701 8/1981 Miyazaki et al. ..... 53/465

*Primary Examiner*—Glen R. Swann, III
*Attorney, Agent, or Firm*—Fleit & Jacobson

[57] ABSTRACT

A sensor is positioned adjacent the wrapping rollers of a coin wrapping machine in the passage of the wrapping sheet. The sensor issues a sheet detection signal when the sheet is detected by the sensor. The control device is also provided with sheet feeding rollers for feeding the wrapping sheet along the passage of the wrapping sheet toward the wrapping rollers. The sheet detection signal is used to control the driving of the sheet feeding rollers, and to stop the sheet feeding rollers in response to the sheet detection signal, so as to stop the leading end of the sheet at a position near the sensor. In this way, the wrapping sheet is advanced from a position near the sensor when the wrapping operation is started. When certain conditions associated with the wrapping sheet are detected in the control device, corresponding alarm signals are issued and the coin wrapping machine is stopped.

6 Claims, 4 Drawing Figures

SHEET FEEDING CONTROL DEVICE FOR USE IN A COIN WRAPPING MACHINE

BACKGROUND OF THE INVENTION

This invention relates to improvements in a sheet feeding control device for use in a coin wrapping machine.

Since the invention is accomplished by providing a sheet feeding device like that of a conventional coin wrapping machine with a sensor for detecting a wrapping sheet in its passage adjacent wrapping rollers and with an associated electrical circuit for controlling the feeding of the wrapping sheet the conventional machine of the type which the invention is based on will first be explained with reference to FIG. 1 showing an embodiment of the invention, which mechanically is substantially the same as the conventional machine except for a sensor.

As shown in FIG. 1, in the conventional machine, when counted and accumulated coins 1 are transferred to a wrapping position among three wrapping rollers 2, 2 and 2, a cam mechanism, not shown, is actuated to move the wrapping rollers 2, 2 and 2 from positions as shown in dotted lines to positions as shown in solid lines where the wrapping rollers pinch the accumulated coins. The leading end of a wrapping sheet 3 is fed between the wrapping rollers and the coins before the wrapping rollers completely pinch or hold the coins 1. After the completion of the pinching, the wrapping sheet 3 is wound about the coins 1 through rotation of the wrapping rollers 2, 2 and 2. Then, the sheet is pulled between a sheet feeding roller 6 for driving the sheet and the wrapping rollers 2, 2 and 2 due to a difference in their peripheral speeds and is, therefore, pushed against a cutter 4 so as to be cut. Thereafter, a pair of crimping claws, not shown, are actuated to crimp the wound sheet at opposite ends thereof. As to the wrapping operation, in view of various points it is preferred that the coins be wrapped with the sheet by two turns. In consideration of this, in case that various coins which have great difference in their diameters are to be handled, the cutter 4 should vary with its position in accordance with each kind or diameter of coins so as to adjust the cut length of the sheet 3 to the diameter of the coin. For this purpose, the cutter may be located, for example, at positions 4*a*, 4*b*, 4*c* or 4*d* in order of decreasing cut length of the sheet. That is, the cutter 4 and the paper feed 6 move as a unit around a pivot (shown at the right side of FIG. 1).

Furthermore, attendent on variation of the cutter's position, it is necessary to vary the feeding period of the sheet or the driving period of the sheet feeding roller 6 and the timing for starting to feed the sheet in accordance with the kinds of coins. In the conventional machine, these variations are accomplished by a combination of a timing cam and microswitches associated therewith or the provision of a delay circuit for delaying an output obtained from the timing cam.

However, in the above-mentioned construction, since the distances between the wrapping rollers and the cutter's positions 4*a*, 4*b*, 4*c* and 4*d* are very long, the feeding of the sheet is liable to be subject to the drifting of the rotational speed of the sheet feeding roller 6 or the load of the rolled sheet before the leading end of the sheet 3 enters the wrapping rollers 2, 2 and 2. Consequently, it is difficult to obtain a stable feeding of a predetermined length of the sheet.

SUMMARY OF THE INVENTION

It is, therefore, an object of the invention to provide a novel sheet feeding control device for use in a coin wrapping machine which eliminates the aforementioned disadvantages. This is accomplished by a sheet feeding control device according to the present invention in which a sensor for detecting the wrapping sheet is provided at the passage of the sheet adjacent the wrapping rollers and the feeding of the sheet is controlled by utilizing a sheet detection signal which is issued by the sensor when it detects the sheet. In the above-mentioned construction, on the basis of a constant timing for starting to feed the sheet and a constant sheet feeding period, the sheet feeding roller can be driven to accurately feed the sheet in spite of variation in the kinds of coins to be handled. Further, a supersonic sensor is preferably used as the sensor for detecting the sheet since it is not liable to be subject to the influence of a dust.

A further object of the invention is to provide a sheet feeding control device of the above type which provides an alarm system for letting the operator know when trouble has occurred during wrapping operation of the coin wrapping machine.

According to the present invention, there is provided a sheet feeding control device for use in a coin wrapping machine in which coins accumulated in a predetermined number are wrapped with a wrapping sheet by wrapping rollers, which comprises a sensor positioned adjacent the wrapping rollers at the passage of the wrapping sheet for detecting the wrapping sheet to generate a sheet detection signal, a sheet feeding roller for feeding the wrapping sheet along the passage of wrapping sheet toward the wrapping rollers, and means for controlling the driving of the sheet feeding roller in accordance with the sheet detection signal.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will be now described in detail with reference to the accompanying drawings.

Figure 1:
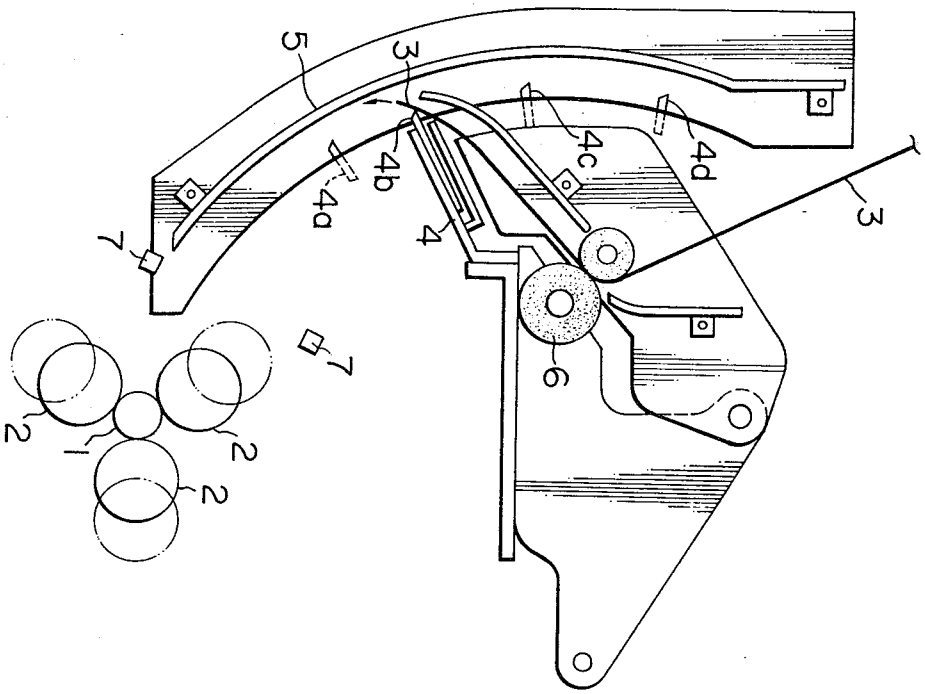
FIG. 1 is a plan view showing an embodiment of the mechanical portion of a sheet feeding control device of a coin wrapping machine according to the invention.

In FIG. 1, the sheet feeding control device includes a sensor 7 and 7 which is provided at the front end of a sheet guide plate 5 adjacent the wrapping rollers 2, 2 and 2. The sensor may be of a supersonic type. In such a case, one part of the sensor is a supersonic wave transmitter and the other part is a supersonic wave receiver. When the sheet 3 is present between the transmitter and the receiver, the sheet is detected by the sensor and, therefore a sheet detection signal is generated to be put in a sheet detection signal input terminal of the control circuit so as to control the feeding of the sheet.

Figure 2:
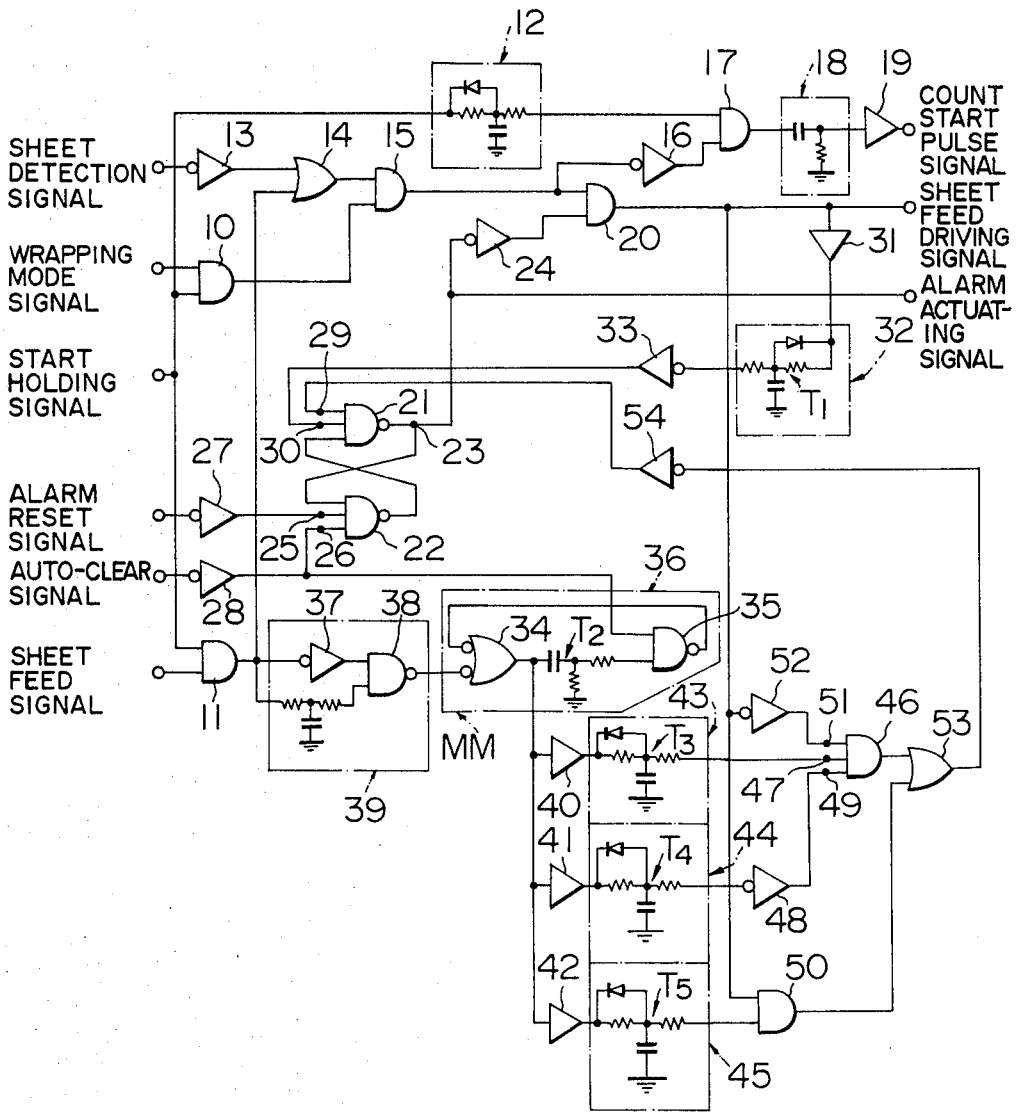
FIG. 2 shows a control circuit used for the sheet feeding control device of FIG. 1.

FIG. 2 shows one embodiment of the above mentioned control circuit. Inputted to the control circuit are a sheet detection signal from the supersonic sensor, a wrapping mode signal issued when the machine is set in a wrapping mode, a start holding signal issued by a manual operation of the operator, an alarm reset signal for resetting an alarm state to a non-alarm state, an auto-clear signal for putting out an "H" (high) level signal for a fixed period after a power supply is switched in, and a sheet feed signal for issuing an "H" level signal with predetermined timing while the wrapping rollers 2, 2 and 2 are moved to pinch the accumulated coins 1 and the wrapping sheet 3. On the other hand, outputted from the control circuit are a count start pulse signal for indicating that a counting section, not shown, has started to count coins, a sheet feed driving signal for indicating that a sheet feeding roller driving section is driving or not driving the sheet feeding roller 6, and an alarm actuating signal for actuating an alarming device, not shown, to let the operator know of any trouble in the wrapping operation as well as for stopping the machine.

The above-mentioned control circuit will be described in detail. The start holding signal is put in an AND circuit 10 at one input terminal thereof, the other input terminal of which the wrapping mode signal is supplied to. The start holding signal is also put in an AND circuit 11 at one input terminal thereof, the other input terminal of which the sheet feeding signal is supplied to. The start holding signal is further put in a T-type delay circuit 12 comprising resistors, a capacitor and a diode.

The sheet detection signal is put in a NOT circuit 13 and the output therefrom is put in at one input terminal of an OR circuit 14, the other input terminal of which is connected to the output terminal of the AND circuit 11. The output from the OR circuit 14 is supplied to an AND circuit 15 at one input terminal thereof, the other input terminal of which is connected to the output terminal of the AND circuit 10. The output from the AND circuit 15 is supplied through a NOT circuit 16 to an AND circuit 17 at one input terminal thereof, the other input terminal of which is connected to the output terminal of the T-type delay circuit 12. The output of the AND circuit 17 is put in a buffer amplifier 19 through a differential circuit 18 which comprises a capacitor and a resistor to issue the count start pulse signal. The count start signal is put in the counting section, not shown, where coins are counted, and when the predetermined number of coins is counted a count end pulse signal is issued to stop the counting of the coins. Then, the coins thus counted and accumulated are transferred among the wrapping rollers 2, 2 and 2 by a conveyor arm, not shown. Thereafter, a wrapping operation start order by which the wrapping rollers 2, 2 and 2 are moved so as to pinch the accumulated coins 1 and the wrapping sheet 3 is issued and at the same time the sheet feed signal is supplied to the AND circuit 11.

The output from the AND circuit 15 is supplied to an AND circuit 20 at one input terminal thereof and the other input terminal thereof is supplied through a NOT circuit 24 with an output issued from the $\overline{Q}$ output terminal of a flip-flop comprising NAND circuits 21 and 22. The output from the AND circuit 20 is used as the sheet feed driving signal for driving the sheet feeding roller 6. The alarm reset signal and auto-clear signal are supplied through NOT circuits 27 and 28 to the reset terminal of the flip-flop. On the other hand, alarm signals which will be described in detail hereinafter are supplied to the set terminals 29 and 30 of the flip-flop. The output from the $\overline{Q}$ output terminal 23 is used as the alarm actuating signal for actuating an alarm device and simultaneously stopping the machine.

The above-mentioned alarm signals include a first alarm signal which is generated when the sheet is not detected by the supersonic sensor 7 after the lapse of a period of $T_1$ seconds after the start holding signal was supplied to the control circuit by the depression of an operating button, not shown, by an operator; a second alarm signal which is generated when the sheet is not cut by the cutter 4 after the sheet was introduced among the wrapping rollers 2, 2 and 2; and a third alarm signal which is generated when the sheet is not detected by the supersonic sensor 7 after the lapse of a period of $T_2$ seconds after the sheet was cut by the cutter 4. The first alarm signal is put out by passing the output from the AND circuit 20 through a buffer amplifier 31, a $T_1$ second delay circuit 32 which comprises resistors, a capacitor and a diode, and a NOT circuit 33 to the set terminal 30 of the flip-flop. The second alarm signal and the third alarm signal are put out in accordance with the operation of a one-shot multivibrator 36. The multivibrator 36 is constructed so that on OR circuit 34 and a NAND circuit 35 are connected to each other by a discharge circuit which comprises resistors and a capacitor and the output from the NAND circuit 35 is fed back to one input terminal of the OR circuit 34. That is, the output from a NOT circuit 28 is supplied to one input terminal of the NAND circuit 35 and the output from the AND circuit 11 is supplied to one input terminal of the OR circuit 34 through a pulse generator 39 which comprises a NAND circuit 38, resistors and a capacitor. The output from the NAND circuit 34 is supplied through buffer amplifiers 40, 41 and 42 to $T_3$ delay circuit 43, $T_4$ delay circuit 44 and $T_5$ delay circuit 45, respectively. Each delay circuit comprises resistors, a capacitor and a diode. The output from the $T_3$ delay circuit 43 is supplied to a second input terminal 47 of an AND circuit 46 and the output from the $T_4$ delay circuit 44 is supplied to a third input terminal 49 of the AND circuit 46 through a NOT circuit 48. The output from the $T_5$ delay circuit 45 is supplied to one input terminal of an AND circuit 50. The output from the AND circuit 20 is supplied through a NOT circuit 52 to a first input terminal 51 of the AND circuit 46 and is also supplied to the other input terminal of the AND circuit 50. The outputs from the AND circuits 46 and 50 are supplied through an OR circuit 53 and a NOT circuit 54 to the set terminal 29 of the flip-flop so as to generate the above mentioned second and third alarm signals, respectively.

Figure 3:
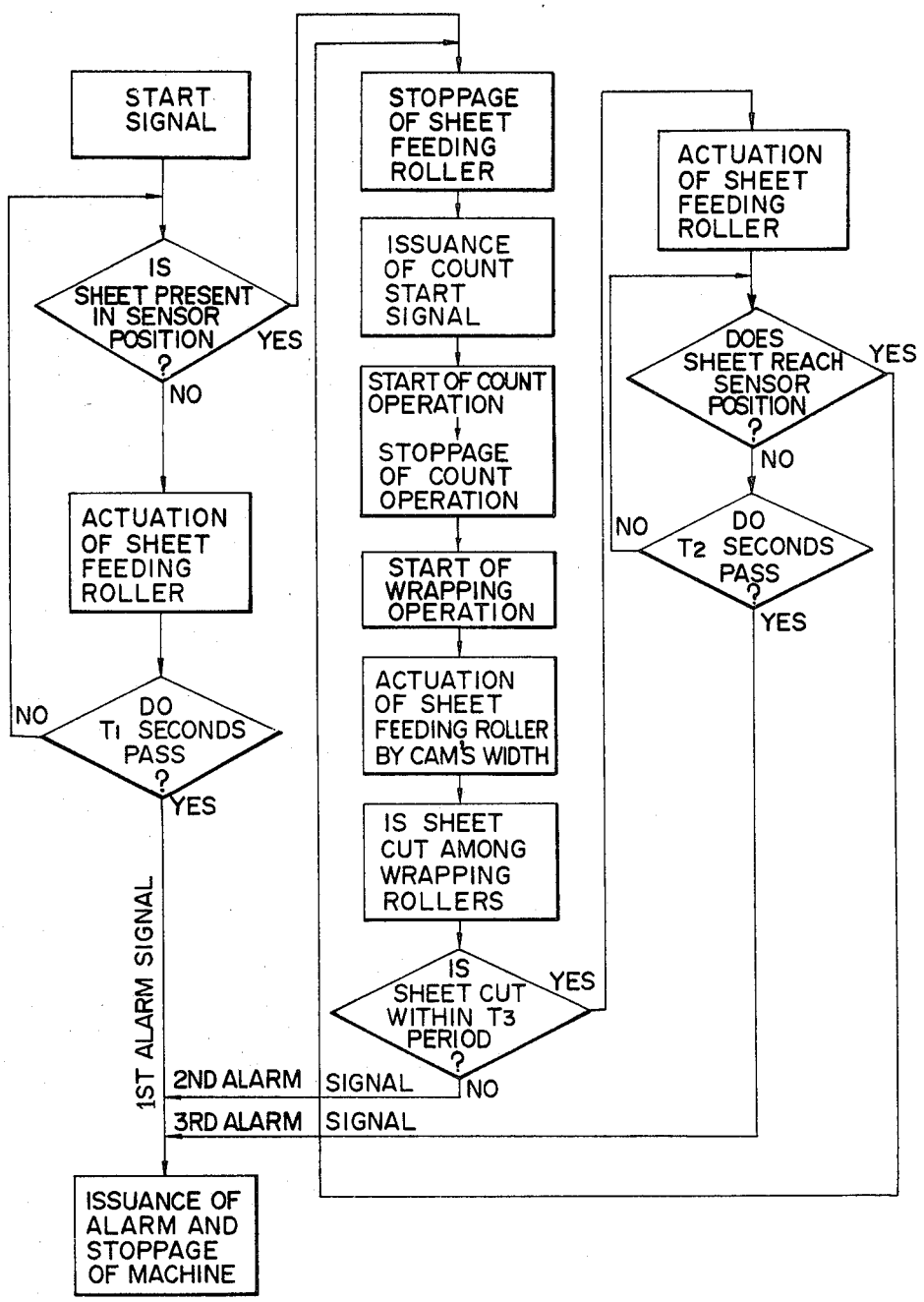
FIG. 3 shows a flow chart for a sequence of operations of the control circuit; and, FIG. 4 shows a time chart for the operations of FIG. 3.
Figure 4:
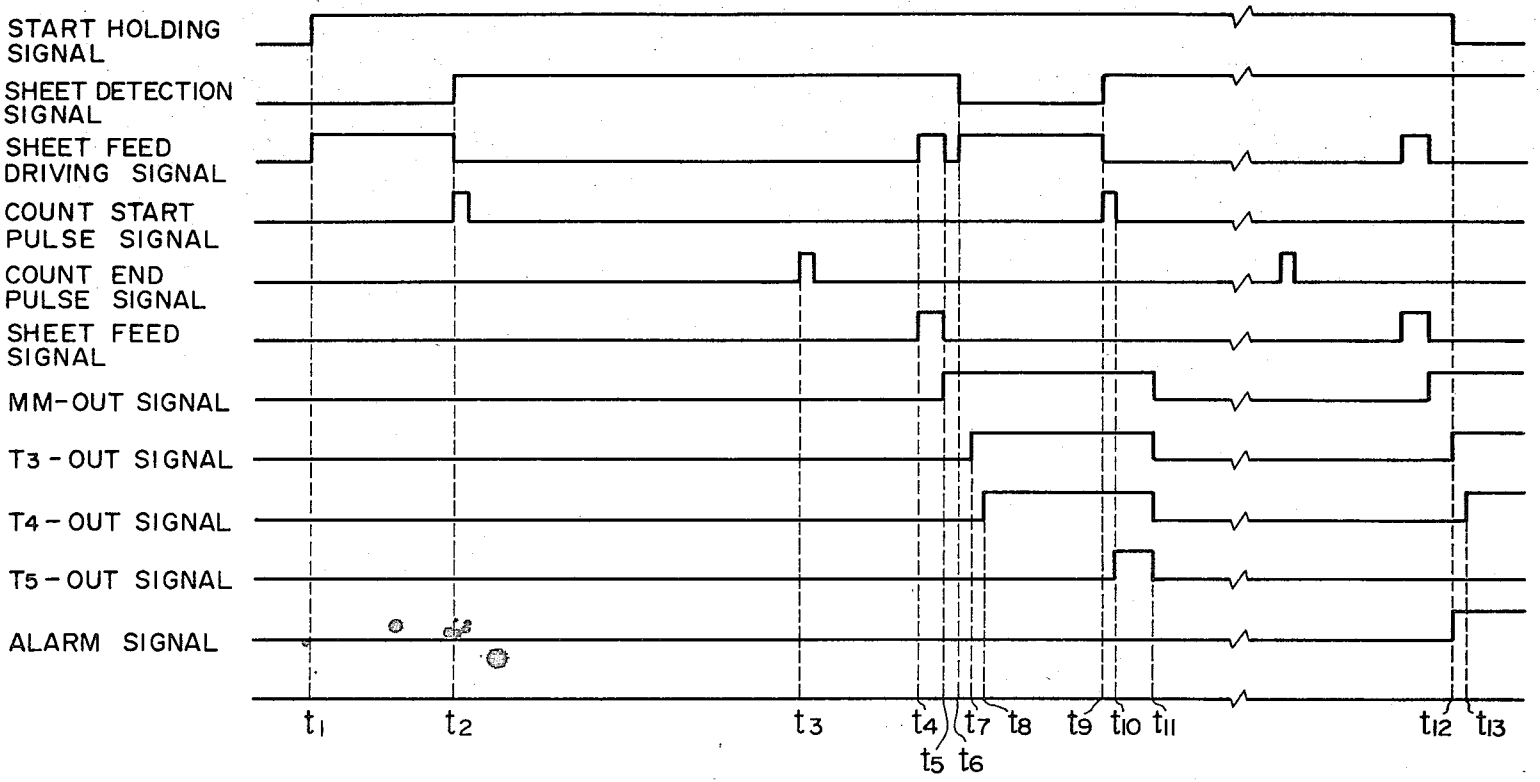

The operation of the above-mentioned control circuit will be now explained with reference to FIG. 4 showing the time chart in sequence of the flow chart shown in FIG. 3.

When the power supply is switched in, an "H" level signal of two-value logic is supplied by a conventional initializing circuit (not illustrated) as the auto-clear signal to the reset terminal 26 of the flip-flop during a predetermined period to hold the $\overline{Q}$ output of the flip-flop in an initial "L" (low) state. In the meanwhile, the coin wrapping machine is set in the wrapping mode, so that an "H" level signal is put in at one input terminal of the AND circuit 10 by the wrapping mode signal. In this state, in order to count and wrap the coins, the operator operates a button for a start holding signal, not shown, to put the start holding signal into the control circuit. At the time, if the sheet 3 is not detected by the supersonic sensor 7, an "L" level signal is put out as the sheet detection signal so as to cause the output of the NOT circuit 13 to be "H" (high). At the time, since the output of the AND circuit 10 is "H", an "H" signal is put in at one terminal of the AND circuit 20. The signal put in at the other input terminal of the AND circuit 20 is also an "H" level signal which is inverted from the "L" $\overline{Q}$ output of the flip-flop. Consequently, the AND circuit 20 puts out an "H" level signal as the sheet feed driving signal (at the time $t_1$ as shown in FIG. 4). Since the "H" sheet feed driving signal is put in the flip-flop through the $T_1$ second delay circuit 32 and the NOT circuit 33, after the lapse of $T_1$ seconds the flip-flop is inverted to change its $\overline{Q}$ output to "H", thereby issuing the alarm actuating signal. The above-mentioned operation insures that when the sheet 3 is not detected by the supersonic sensor 7 after the lapse of $T_1$ seconds after the sheet was fed, the first alarm signal is generated to issue the alarm actuating signal and simultaneously the machine is stopped so that the cause for non-feeding of the sheet can be checked. Further, when the alarm actuating signal is produced, the machine is constructed so that the start holding signal is made "L" through a circuit (not shown). Therefore, after the operator makes an operation for issuing the alarm reset signal and removes the cause for trouble, the operation of the machine again begins from the start.

In case that the sheet is detected before the lapse of $T_1$ seconds, since the "H" sheet detection signal is provided at the sheet detection signal terminal in FIG. 2, the output of the OR circuit 14 is made "L" and, therefore an "L" signal is put out as the sheet feed driving signal. Simultaneously, each of the "H" signals is put in each of two input terminals of the AND circuit 17 to cause the count start pulse signal to be issued through the differential circuit 18 (at the time $t_2$ as shown in FIG. 4). That is, in FIG. 1, when the leading end of the sheet is detected by the supersonic sensor 7, the feeding of the sheet is stopped. In this state, the counting of the coins is started. When the counting of a predetermined number of coins is, then, completed, the count end pulse signal is issued (at the time $t_2$ of FIG. 4). The coins thus counted are then transferred among the wrapping rollers 2, 2 and 2 and the wrapping operation is started. That is, the wrapping rollers 2, 2 and 2 are started to move toward the accumulated coins to pinch the same and the "H" sheet feed signal, generated by a cam (not shown) which is actuated in response to radial movement of the wrapping rollers, is supplied to one input terminal of the AND circuit 11. Since the "H" sheet feed signal is put in the OR circuit 14 through the AND circuit 11, the "H" sheet feed driving signal is put out at the output terminal of the AND circuit 20, thereby driving the sheet feeding roller 6 to feed the sheet among the wrapping rollers 2, 2 and 2 with predetermined timing. In other words, no matter what kind of coins are to be wrapped, since the sheet is fed from a position where the leading end of the sheet 3 is located at the supersonic sensor 7 and the sheet is fed a very short distance between the above-mentioned position and the wrapping position among the wrapping rollers 2, 2 and 2 during a fixed period (from time $t_4$ to time $t_5$), a fixed timing for pinching the sheet among the wrapping rollers can be provided.

At the time $t_5$, the feeding of the sheet is stopped. Thereafter, while the sheet 3 is wound about the coins by the wrapping rollers 2, 2 and 2, the sheet is cut by the cutter 4. Then, the sheet detection signal is made "L" (at the time $t_6$) when the trailing end of the sheet 3 passes by the sensor 7. Consequently, as aforementioned, the OR circuit 14 is made "H" to put out the "H" sheet feed driving signal. On the other hand, at the time $t_5$ when the sheet feed signal is inverted from "H" to "L", since a pulse is put out from the pulse generator circuit 39 to actuate the one-shot multivibrator 36, an MM-OUT signal is put out at the output of the NAND circuit 34 (from time $t_5$ to time $t_{11}$). The MM-OUT signal has an "H" level for longer than $T_2$ seconds. The MM-OUT signal causes the $T_3$ delay circuit 43, the $T_4$ delay circuit 44 and the $T_5$ delay circuit 45 to put out a $T_3$-OUT signal, a $T_4$-OUT signal and a $T_5$-OUT signal, respectively, which are delayed by predetermined periods as shown at rise times $t_7$, $t_8$ and $t_{10}$.

The subsequent operations of the control circuit after the time $t_6$ when the sheet 3 is cut by the cutter 4 and the "H" sheet feed driving signal is put out will be explained. The sheet feed driving signal continues to drive the sheet feed roller 6 until the sheet is detected by the supersonic sensor 7. When the sheet is detected (at the time $t_9$), the count start pulse signal is put out as mentioned above to repeat the counting and wrapping operations of a second cycle. However, if for some reason the sheet is not cut at the time $t_6$, an "H" signal is supplied to the first input terminal of the AND circuit 46 since the sheet feed driving signal is maintained to be "L", that is, the sheet detection signal is maintained to be "H". Therefore, when the $T_3$-OUT signal is "H" and the $T_4$-OUT signal is "L" (this state substantially corresponds to the period from time $t_{12}$ to time $t_{13}$ in FIG. 4), all "H" signals are put in at the first, second and third input terminals of the AND circuit 46 and, therefore the set terminal 29 of the flip-flop is made "L" to issue the second alarm signal and stop the machine. On the other hand, in case that the sheet is not detected at the time $t_{10}$, the $T_5$-OUT signal is supplied to the AND circuit 50 at the time corresponding to the time $t_{10}$ and the set terminal 29 is made "L" in a similar manner to issue the third alarm signal and stop the machine. Further, the period of $T_1$ seconds is selected to be longer than the period of $T_2$ seconds. In other words, the period of $T_1$ seconds is longer than the period between the time $t_5$ where the MM-OUT signal arises and the time $t_{10}$ where the $T_5$-OUT signal arises, and therefore does not issue the first alarm signal when the third alarm signal is issued.

Further, for explanation's sake, the time $t_{12}$ and time $t_{13}$ of FIG. 4 merely show the relationship in time in the case that the second alarm signal is issued as mentioned above.

What is claimed is:

1. A sheet feeding control device for use in a coin wrapping machine wherein coins accumulated in a predetermined number are wrapped with a wrapping sheet by wrapping rollers, said device comprising:

sheet feeding rollers for feeding the wrapping sheet toward the wrapping rollers;

a sensor positioned adjacent the wrapping rollers along the path of the wrapping sheet for detecting the presence of the wrapping sheet in a given position along said path to generate a sheet detection signal;

a cutter positioned between said sensor and said sheet feeding rollers for cutting the wrapping sheet at the end of the wrapping operation;

driving means for driving said sheet feeding rollers to advance the leading end of the wrapping sheet toward the wrapping rollers after the wrapping sheet is cut by said cutter; and stopping means for stopping said sheet feeding rollers in response to said sheet detection signal so as to stop the leading end of the wrapping sheet at a position near said sensor until the wrapping operation is started;

whereby the wrapping sheet is then advanced from a position near the sensor once the wrapping operation is started.

2. A device as set forth in claim 1, further comprising additional stopping means for stopping said sheet feeding rollers after the coins have been wrapped with the wrapping sheet, and for imparting a tension to the wrapping sheet to facilitate cutting of the wrapping sheet by the cutter.

3. A device as set forth in claim 1, wherein said driving means is actuated to advance the leading end of the wrapping sheet from the position near the sensor toward the wrapping rollers when the wrapping rollers start to be moved and rotated, so as to wrap the coins with the wrapping sheet.

4. A device as set forth in claim 1, further comprising alarm means for issuing an alarm when the sensor does not generate the sheet detection signal in a predetermined period after a start button is depressed.

5. A device as set forth in claim 2, further comprising alarm means for issuing an alarm when the cutter does not cut the wrapping sheet in a predetermined period after the coins have been wrapped with the wrapping sheet.

6. A device as set forth in claim 1, further comprising alarm means for issuing an alarm when the sensor does not generate the sheet detection signal in a predetermined period after the cutter has cut the wrapping sheet.

* * * * *